US006174095B1

(12) United States Patent
Desie et al.

(10) Patent No.: US 6,174,095 B1
(45) Date of Patent: Jan. 16, 2001

(54) PRINTER FOR LARGE FORMAT PRINTING

(75) Inventors: Guido Desie, Herent; Jacques Leonard, Antwerp; Hilbrand Van den Wijngaert, Grobbendonk; Ludo Joly, Hove; Dirk Broddin, Edegem, all of (BE)

(73) Assignee: Agfa-Gevaert, Mortsel (BE)

( * ) Notice: Under 35 U.S.C. 154(b), the term of this patent shall be extended for 0 days.

(21) Appl. No.: 09/544,066

(22) Filed: Apr. 6, 2000

Related U.S. Application Data

(62) Division of application No. 08/994,094, filed on Dec. 19, 1997, now Pat. No. 6,074,112
(60) Provisional application No. 60/038,768, filed on Feb. 20, 1997.

(30) Foreign Application Priority Data

Dec. 19, 1996 (EP) ..... 96203636

(51) Int. Cl.[7] ..... B41J 2/315
(52) U.S. Cl. ..... 400/118.3; 347/55
(58) Field of Search ..... 400/120.01, 118.3; 347/40, 55, 114, 247; 346/155, 157, 159

(56) References Cited

U.S. PATENT DOCUMENTS 5,128,695 * 7/1992 Maeda ..... 347/55
5,327,169 * 7/1994 Thompson ..... 346/155
5,353,050 * 10/1994 Kagayama ..... 347/55
5,359,147 * 10/1994 Satoh ..... 118/653
5,477,250 * 12/1995 Larson ..... 347/55
5,714,992 * 2/1998 Desie ..... 347/55
5,949,449 * 9/1999 Takahashi ..... 347/40
5,975,683 * 11/1999 Smith et al. ..... 347/55
6,019,453 * 2/2000 Tsuruoka ..... 347/40

* cited by examiner

*Primary Examiner*—Eugene Eickholt
(74) *Attorney, Agent, or Firm*—Baker Botts L.L.P.

(57) ABSTRACT

A single pass printer, having a printing width (PW) is provided or printing a toner image on a substrate, the substrate having a width (WS) and a length (LS), wherein, i) a number n, equal to or larger than 2, of printing engines, each containing a toner transferring element with a longitudinal axis (width (WPE)) smaller than the printing width (PW) are present, and at least two of the n printing engines, each containing a toner transferring element with a longitudinal axis in the direction of width (WPE), are located so that the longitudinal axis do not coincide. Preferably the printing engines are electro(stato)graphic engines, especially Direct Electrostatic Printing (DEP) engines or electrophotographic engines.

8 Claims, 6 Drawing Sheets

PRINTER FOR LARGE FORMAT PRINTING

The application is a divisional of application Ser. No. 08/994,094 filed Dec. 19, 1997 now U.S. Pat. No. 6,074,112 which claims the benefit of the U.S. Provisional Application No. 60/038,768 filed Feb. 20, 1997.

FIELD OF THE INVENTION

This invention relates to a printing apparatus for large format printing. It relates especially to a large format printer comprising electrostatographic printing devices.

BACKGROUND OF THE INVENTION

In large format printing, e.g. poster printing, billboard printing, wherein the weatherability of the print is very important, silk-screen printing is still a dominant printing method. This method has however drawbacks. The method is rather time consuming since for every colour a dedicated screen has to be made and printed and the method is basically analog.

More and more images to be printed are available in digital form, so that also in the printing of large formats, digital addressable printing techniques become indispensable.

A well known digital addressable printing technique that is useful for large format printing is ink-jet printing, both with water based inks and with solvent based inks. An example of an ink-jet printer for large format printing can be found in, e.g., U.S. Pat. No. 5,488,397, wherein a printer is disclosed having two or more parallel ink-cartridges shuttling over the width of the substrate to be printed while the substrate moves in a direction basically perpendicular to the direction of movement of the shuttling ink-cartridges.

In WO 96/01489 an ink-jet printer for large format printing is disclosed wherein a single ink-cartridge shuttles over the substrate to be printed.

In U.S. Pat. No. 4,864,328 an ink-jet printer is disclosed, wherein only one printing engine (ink-jet head)having a multiple array of nozzles is moved as a shuttle over the paper.

In EP-A-526 205 again an ink-jet printer is disclosed, wherein only one printing engine (ink-jet head)having a multiple array of nozzles is moved as a shuttle over the paper.

A commercial ink-jet printer INDANIT 162Ad (trade name) available from Indanit Technologies, Israel, uses multiple ink-jet printheads mounted in a staggered position over the width of the substrate to be printed. In this device the printing substrate has to pass several times under the array of staggered ink-jet printheads while between each pass the printheads are slightly moved in a direction parallel to the width of the substrate. This multi-pass printing enhances the resolution that can be printed, while in the printhead itself the nozzle can be positioned fairly far apart.

Although ink-jet printing provides the possibility for printing large formats in a short time, the possible printing resolution is not always up to the demands, the stability of the image in, e.g., billboards where the image has to be weatherproof leaves still room for improvement.

In U.S. Pat. No. 5,138,336 a thermal printer using at least two thermal printing heads is described for printing on large substrates.

In U.S. Pat. No. 5,237,347 an electrophotographic printer is disclosed wherein a single photoconductor is exposed to the light of several exposure units, so a large latent image can be written on the photoconductor and after development be transferred to a final substrate.

In WO-A-96 18506 a shuttling printer using more than one direct electrostatic printing engine is disclosed wherein these engines are placed one after an other for printing multi-colour swaths.

In the art of printing of large formats, it is however still desired to have still faster printers that use very weatherable marking material, especially toner particles. In toner particles the pigments are imbedded in a resin and thus are the pigments in the image quite protected from the influences of the environment.

OBJECTS AND SUMMARY OF THE INVENTION

It is an object of the invention to provide a printer for high speed printing of large format images with good resolution.

It is a further object of the present invention to provide a printer, printing large format images with a high printing speed and using dry printing methods and toner particles.

It is a further object of the invention to provide a printer for printing large format printouts at a high printing speed with good long term stability and reliability.

Further objects and advantages of the invention will become clear from the description hereinafter.

The objects of the invention are realised by providing a single pass printer, having a printing width (PW) for printing a toner image on a substrate, having a width (WS) and a length (LS), characterised in that, i) a number n, equal to or larger than 2 of printing engines, each containing an element with a longitudinal axis (WPE) smaller than said printing width (PW) are present, for applying toner to said substrate, ii) at least two of said n printing engines, are located so that said longitudinal axis do not coincide.

Preferably said printing width is at least 40 cm, and said longitudinal axis are essentially parallel.

Preferably said printing engines are electro(stato)graphic engines.

DEFINITIONS

Figure 1:
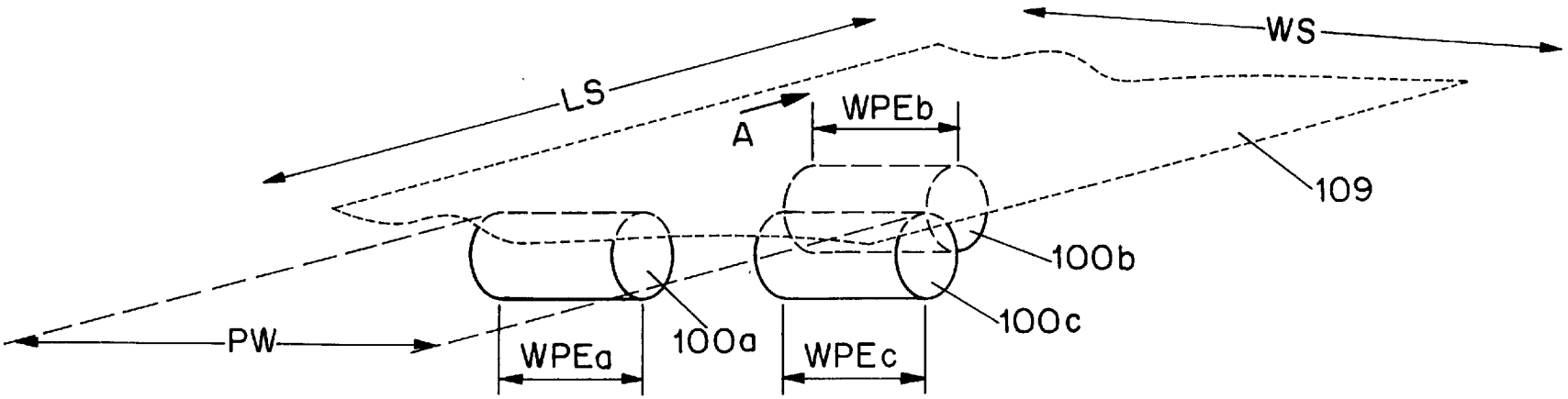
FIG. 1 is a schematic perspective view of a printer according to the first specific embodiment of the present invention.

In this document the wording "toner transferring element or elements" is used to designate those parts of a printing engine used to provide a toner image either on an intermediate image bearing member or on a final substrate to be printed. In a DEP printing engine, the "toner transferring element" or "element for applying toner particles" is or are the row(s) of printing apertures in the printhead structure. In an electrophotographic printing engine, the "toner transferring element" or "element for applying toner particles" is or are the latent image bearing member(s).

In this document the wording "staggered printing engines" is used to indicate a number of printing engines (at least two), each of the printing engines comprising a toner transferring element, that are positioned in the printer so that at the longitudinal axis of the toner transferring means, comprised in at least two of the number of printing engines do not coincide.

The wording "substrate" or "image receiving element" can in this document mean a final image receiving element whereon the toner image is printed, as well as an "intermediate image receiving member" used to accept a toner image and to transfer that image to a final image receiving member.

The width of the image receiving substrate (WS) is the dimension of that substrate that is essentially perpendicular to the direction of movement of the substrate in the printer.

The length of the image receiving substrate (WL) is the dimension of that substrate that is essentially parallel to the direction of movement of the substrate in the printer.

DETAILED DESCRIPTION OF THE INVENTION

It was found that by using at least two and preferably at least three printing engines, spread over the width of the substrate to be printed and arranged so that the longitudinal axis of the toner transferring elements of at least two of the printing engines do no coincide, a fast high resolution printer for large (large means herein having a surface of at least 0.25 $m^2$ and an image width of at least 30 cm) formats could be built. A printer according to this invention can be constructed in such a way that any printing width, from 10 cm up to more than, e.g., 5 meter, can be realised. Preferably a printer according to this invention is manufactured such as to have a printing width (PW) of at least 40 cm, preferably of at least 60 cm and more preferably of at least 120 cm.

A printer according to this invention is a "single pass" printer, i.e. the substrate passes the printing engines only once. For example, a printer, wherein several printing engines are rigidly mounted over the total width of the substrate to be printed, so that the longitudinal axis of the toner transferring elements of at least two of the printing engines do not coincide, and that is equipped with means for moving said substrate with respect to said printing engines in a single direction, is a single pass printer according to the present invention. In a multiple pass printer, of the image information being adapted to be printed with printing engines with width WPE, (i.e. a printing line) is not printed in its totality, but in portions. Thus in a multiple pass printer a first portion of a printing line is printed on a first area of the substrate while the substrate passes the printing engines, then the substrate is returned and passed a second time past the printing engine for printing a second portion of the line, and so on until the total printing line is printed. In a single pass printer all the image information being adapted to be printed with printing engines with width WPE, (i.e. a printing line) is printed in its totality on an area of the substrate being present near the printing engines and the substrate is moved further on, an a further line is printed, and so on.

The printing engines, used in this invention, can be ink-jet printing engines, ionographic printing engines, magnetographic printing engines and the like. It is preferred in this invention to use electro(stato)graphic printing engines and especially electrophotographic and direct electrostatic printing (DEP) engines.

In DEP (Direct Electrostatic Printing) the toner or developing material is deposited directly in an image-wise way on a receiving substrate, the latter not bearing any image-wise latent electrostatic image. The substrate can be an intermediate endless flexible belt (e.g. aluminium, polyimide etc.), wherefrom the image-wise deposited toner are transferred onto a final substrate. The toner can also deposited directly on the final receiving substrate, thus creating the image directly on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

A DEP device comprises essentially a printhead structure with printing apertures positioned between a toner container and substrate to be printed. A flow of charged toner particles from a toner container to the substrate can be image-wise modulated by the printhead structure. A DC field between the toner container and the substrate, e.g., created by having a back electrode behind the substrate, create the toner flow. By adjusting an individual DC field around each of the printing apertures, charged toner particles are allowed to pass the apertures or not. The individual DC fields around each of the printing apertures are image-wise modulated.

A first specific embodiment of the invention

In FIG. 1 a schematic perspective view of a printer according to a first specific embodiment of this invention is shown. Three printing engines (100*a, b* and *c*), each comprising a toner transferring element with a respective longitudinal axis in the direction of width WPEa, WPEb and WPEc are positioned in a staggered configuration under an image receiving substrate (109), having a width (WS) and a length (LS) and travelling in the direction of arrow A. (in FIG. 1. the substrate is shown as transparent for the sake of clarity). The respective widths of the printing engines, the number of printing engines and an optional overlap of some or all of the printing engines, is chosen in such a way that the desired printing width (PW), preferably larger than 40 cm, is reached. It is preferred that the respective longitudinal axis of the respective toner transferring elements are essentially parallel to each other and to the width of the substrate.

In FIG. 1, the three staggered printing engines are considered as a set of printing engines. Such a set of printing engines can be used to print a single colour and when this is in fact done, then a colour printer according to this invention comprises, multiple sets of staggered printing engines, e.g., one set for each colour to be printed. For example, a printer according to the first specific embodiment of this invention, wherein each set of staggered printing engines prints only one colour, will for printing four colours, e.g., yellow, magenta, cyan and black (YMCK), comprise four sets of staggered printing engines.

It is possible, in a printer according to this invention, to use colour printing engines so as to have a colour printer with one set of staggered printing engines.

A second specific embodiment of the invention

Figure 2:
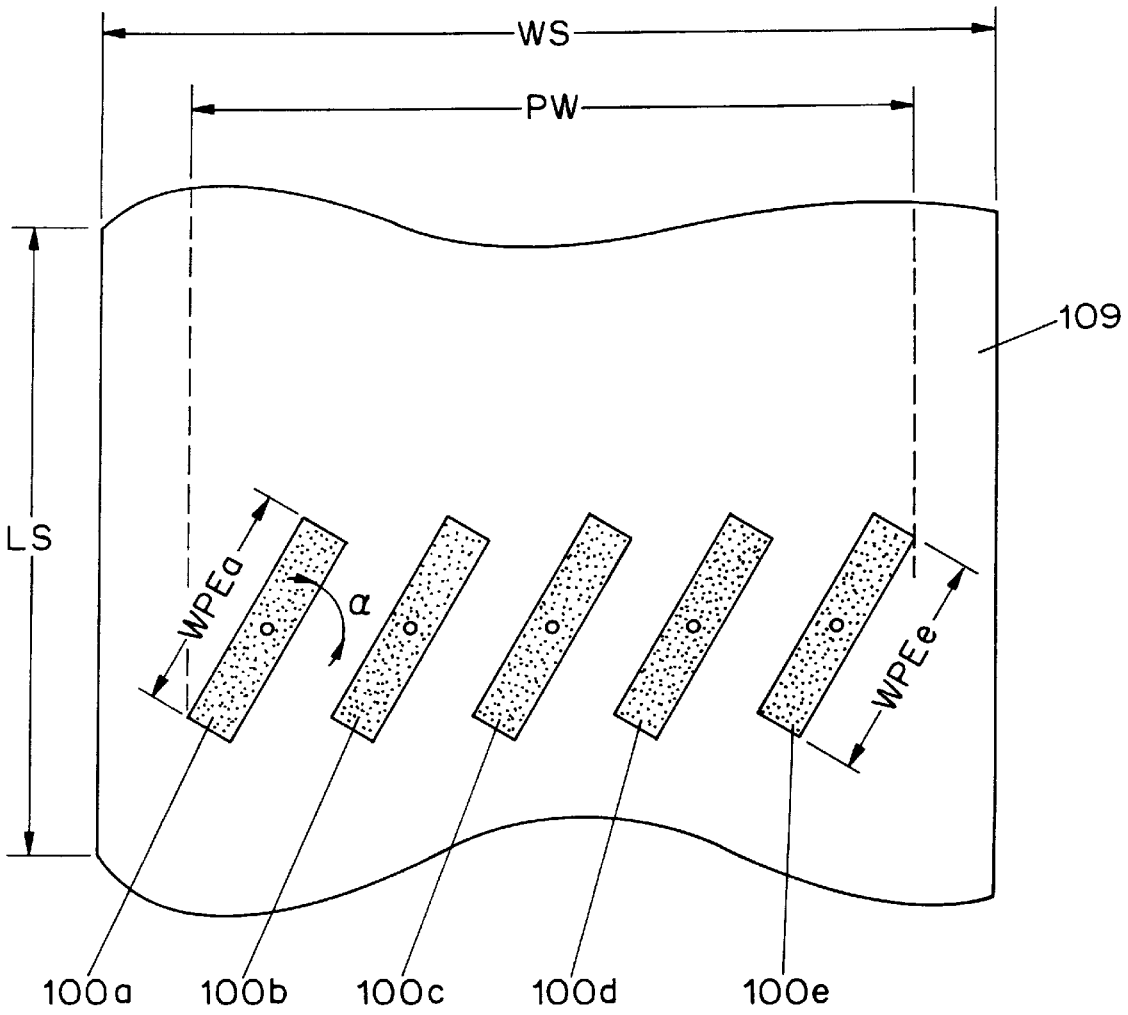
FIG. 2 is a schematic illustration of a printer according to the second specific embodiment of the present invention.

In FIG. 2 a schematic perspective view of a printer according to the second specific embodiment of this invention is shown.

Five printing engines (100*a, b, c, d*, and *e*), each comprising a toner transferring element with respective longitudinal axis in the direction of widths WPEa, WPEb, WPEc, WPEd and WPEe are rigidly arranged so that the respective longitudinal axis are essentially parallel to each other and that the centre points of the respective toner transferring elements are on one line. This line is preferably essentially parallel to the width (WS) of the substrate to be printed. The respective longitudinal axis form an angle a ($0°<a<90°$) with the line through the centre point. Preferably the respective widths of the printing engines are equal and the number of printing engines installed for realising a printer with printing width (PW) is determined as a function of the width of the printing engine and angle $\alpha$according to the formula: $n>PW/((\cos\alpha).WPE)$. When it is desired to achieve a large printing width (PW) with only a limited number of printing engines the angle a can be calculated from the formula above.

In FIG. 2, the five printing engines are considered as a set of printing engines. Such a set of printing engines can be used to print a single colour and when this is in fact done, then a colour printer according to this invention comprises, multiple sets of printing engines, e.g., one set for each colour to be printed, arranged as shown in FIG. 2. For example, a printer according to the second specific embodiment of this invention, wherein each set of printing engines print only one colour, will for printing four colours, e.g., yellow, magenta, cyan and black (YMCK), comprise four sets of printing engines. These sets can then be located one after an other and the substrates moves past said four sets, but since each set prints the totality of a line at once in one colour, the printer is still a single pass printer.

It is possible, in a printer according to this invention, to use colour printing engines so as to have a colour printer with one set of printing engines.

In both FIGS. 1 and 2 the printing engines are shown as printing directly to the substrate, i.e. transferring the toner directly from the toner transferring element to the final substrate. It is possible, in a printer according to this invention, to transfer the toner image first to an intermediate substrate, .e.g., a drum or belt having a width equal to the printing width, and then further transfer the image to the final substrate.

Both embodiments of the present invention can be implemented by using DEP printing engines as well as by using electrophotographic printing engines.

An implementation with DEP printing devices.

Figure 3:
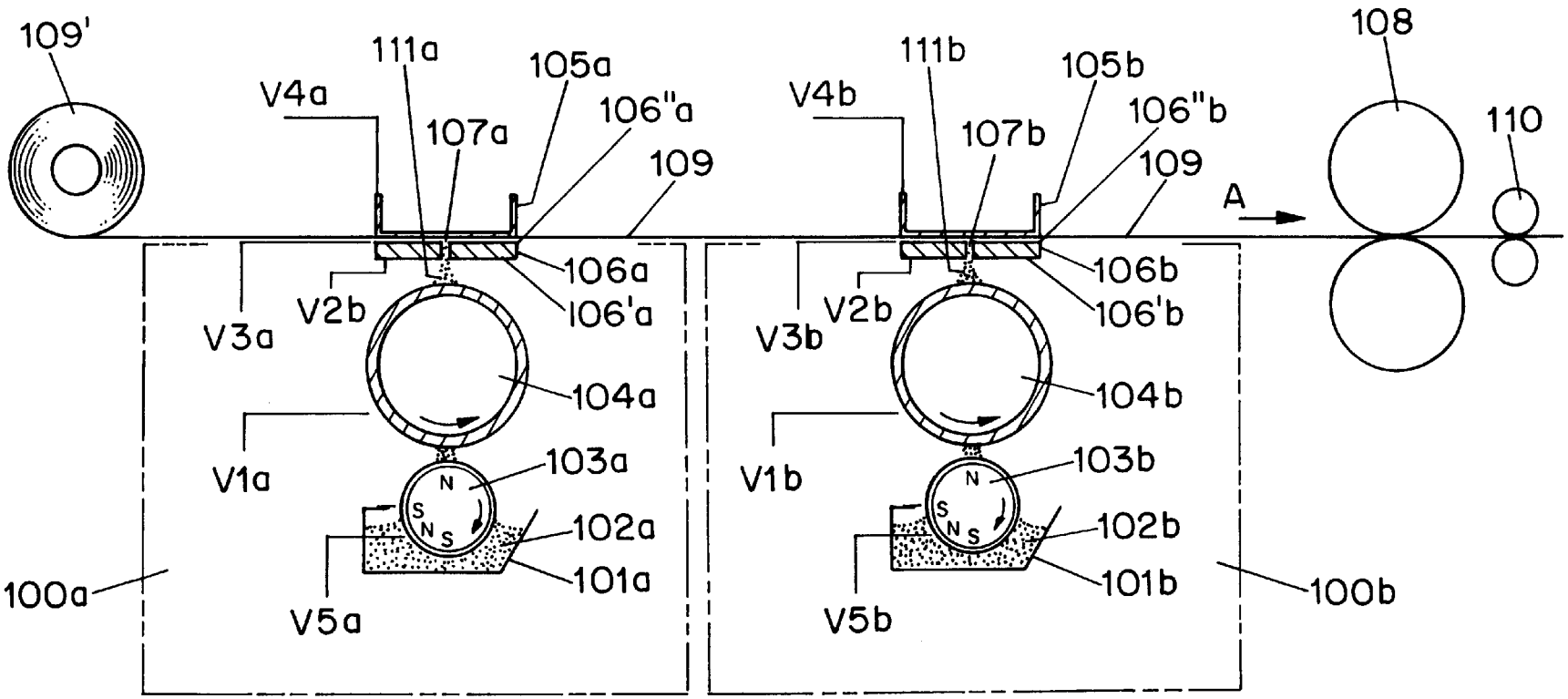
FIG. 3 is a schematic illustration of a printer according to the first specific embodiment of the invention using DEP printing engines.

In FIG. 3 a detailed lateral view of a printer according to the first specific embodiment of this invention, and using DEP printing engines, is given. The DEP printing engines shown in FIG. 3 are equally well suited for use in the second specific embodiment of the invention.

In FIG. 3 only printing engines 100*a* and 100*b* are shown.

Each DEP printing engines comprise:

(i) charged toner conveyors (CTC's) (104 *a* and *b*) providing clouds of toner particles (toner cloud) (111*a* and *b*) in the vicinity of printing apertures (107*a* and *b*), (ii) toner delivery means (101*a,b*), each comprising a container for developer (102*a* and *b*) and a magnetic brush assembly (103*a* and *b*), the magnetic brush assemblies applying an amount of charged toner particles on the charged toner conveyors (104*a* and *b*), (iii) back electrode (105*a* and *b*), a DEP printing engine in a printer according to all embodiments of the present invention can also operate without a back electrode. In that case, on the substrate to be printed a conductive layer is present and an electrical field, creating a flow of charged toner particles, is applied between the conductive layer and the toner delivery means, such a DEP device has been disclosed in European Application 96202228, field on Aug. 8, 1996.

(iv) printhead structures (106*a* and *b*), made from a plastic insulating film, coated on both sides with a metallic film. The printhead structures (106*a* and *b*) each comprise one continuous electrode surface, hereinafter called "shield electrode" (106'*a* and *b*), facing in the shown implementation the toner delivering means and a complex addressable electrode structure, hereinafter called "control electrode" (106"*a* and *b*), around printing apertures (107*a* and *b*), facing, in the shown implementation, the toner receiving member in the DEP device. The location and/or form of the shield electrode (106') and the control electrode (106") can, in other embodiments of a DEP device according to the first specific embodiment of this invention, be different from the location shown in FIG. 3, (v) conveyer means (108), to convey a substrate in the form of a web (109), withdrawn from a roll (109') between the printhead structure and the back electrode in the direction indicated by arrow A, and (vi) means for fixing (110) the toner onto the substrate.

Each of the DEP printing engines, wherein the alignment of the various constituents is properly effected, are positioned in the staggered configuration in such a way that no banding due to overlapping or missing dots could be observed.

In FIG. 3, V1*a* and *b,* V2*a* and *b,* V3*a* and *b,* V4*a* and *b,* and V5*a* and *b,* indicate the different voltages applied to the different parts of the DEP device, thus creating the necessary electrical fields for the operation of the device. Between the printhead structure (106) and the charged toner conveyor (104), as well as between the charged toner conveyor and the magnetic brush assembly (103) as well as between the control electrode around the printing apertures (107) and the back electrode (105) behind the toner receiving member (109) as well as on the single electrode surface or between the plural electrode surfaces of the printhead structure (106) different electrical fields are applied. In the specific embodiment of a device, useful for a DEP method, shown in FIG. 2, (since for both DEP engines shown in FIG. 3, the configuration of the voltages is the same, are the suffixes a and b omitted in the following) voltage V1 is applied to the sleeve of the charged toner conveyor 104, voltage V2 to the shield electrode 106', voltages V30 up to V3*n* for the control electrode (106"). The value of V3 is selected, according to the modulation of the image forming signals, between the values V30 and V3*n,* on a time-basis or grey-level basis. Voltage V4 is applied to the back electrode behind the toner receiving member. In other implementations of the present invention multiple voltages V20 to V2*n* and/or V40 to V4*n* can be used. Voltage V5 is applied to the sleeve of the magnetic brush assemblies.

The magnetic brush assemblies, bringing charged toner particles on the surface of the charged toner conveyor (CTC) in DEP printing engine used in a printer according to this invention, can beneficially comprise two magnetic brushes, a pushing and a pulling one. By push-pull magnetic brushes are meant two different magnetic brushes depositing a layer of toner particles upon the charged toner conveyer from a multi-component developer (e.g. a two-component developer, comprising carrier and toner particles wherein the toner particles are triboelectrically charged by the contact with carrier particles or 1.5 component developers, wherein the toner particles get tribo-electrically charged not only by contact with carrier particles, but also by contact between the toner particles themselves). Such developers have been described in U.S. Pat. No. 5,359,147. The first of the two different magnetic brushes is a pushing magnetic brush, used to jump charged toner particles to the CTC and being connected to a DC-source with the same polarity as the toner particles. The second of the two magnetic brushes is a pulling magnetic brush, used to remove toner particles from the CTC and connected to a DC-source with a polarity opposite to the polarity of the toner particles. By adapting the respective voltages applied to the surface of the respective sleeves the resulting push/pull mechanism provides a way of applying a highly homogeneous layer of well behaved charged toner particles upon the charged toner conveyor. This configuration has the advantage that charged toner upon the CTC that has not been used in the image-wise deposition step is removed from the CTC so that only fresh and well behaved charged toner is propelled through the printhead apertures.

It is clear that DEP devices, wherein the magnetic brush assemblies bringing charged toner particles to the CTC's, are replaced by other charged toner application modules such as e.g. non-magnetic-mono-component modules or magnetic mono-component modules, are further implementations of DEP devices used in printers for large format printing according to this invention and are within the scope of the present invention.

In a further possible configuration of DEP engines used in a printer according to the present invention, the toner delivery means is a magnetic brush assembly and the charged toner particles forming toner clouds (111*a* and *b*) are directly extracted from the magnetic brush and propelled through the printing apertures. In a still further configuration of a DEP device useful in a printer according to this invention, the charged toner particles forming toner clouds (111*a* and *b*) are directly extracted from a non-magnetic-mono-component applicator module.

When DEP devices are used to implement the first specific embodiment of the present invention, the different DEP printing engines can be staggered so that one combination partly sideways overlaps with a second combination structure, thus creating a redundant system. With four DEP printing engines, each of them overlapping the other ones by 75%, a single image pixel can be written from 4 different printhead structures. A large format printer according to this principle has the advantage that small deficiencies in a single aperture have limited impact upon the final result while fast overall printing speeds become available. For large format printing this is a very interesting benefit that greatly compensates for the enhanced complexity and cost of the apparatus. Moreover, it is very interesting with regard to the contone quality of the device according to this principle, since each image pixel on the substrate is filled with toner particles from four distinct apertures.

Both embodiments of the invention can in fact be implemented by using any DEP device known in the art. Typical DEP devices useful for implementing the first specific embodiment of the present invention have been disclosed in, e.g. EP-A 675 417, EP-A 708 386, EP-A 710 897, EP-A 710 898, EP-A 731 394, EP-A 736 822, U.S. Pat. No. 5,539,438, U.S. Pat. No. 5,202,704, U.S. Pat. No. 5,283,594, U.S. Pat. No. 5,036,341, U.S. Pat. No. 5,374,949, U.S. Pat. No. 4,814,796, U.S. Pat. No. 5,204,696, U.S. Pat. No. 5,327,169, etc.

An implementation with classical electrophotographical printing devices.

In a classical electrostatographic printing engine, a latent image is formed on a latent image bearing member, the latent image is developed with toner particles to form a visible image and wherein the visible image is transferred to the image receiving substrate.

Figure 4:
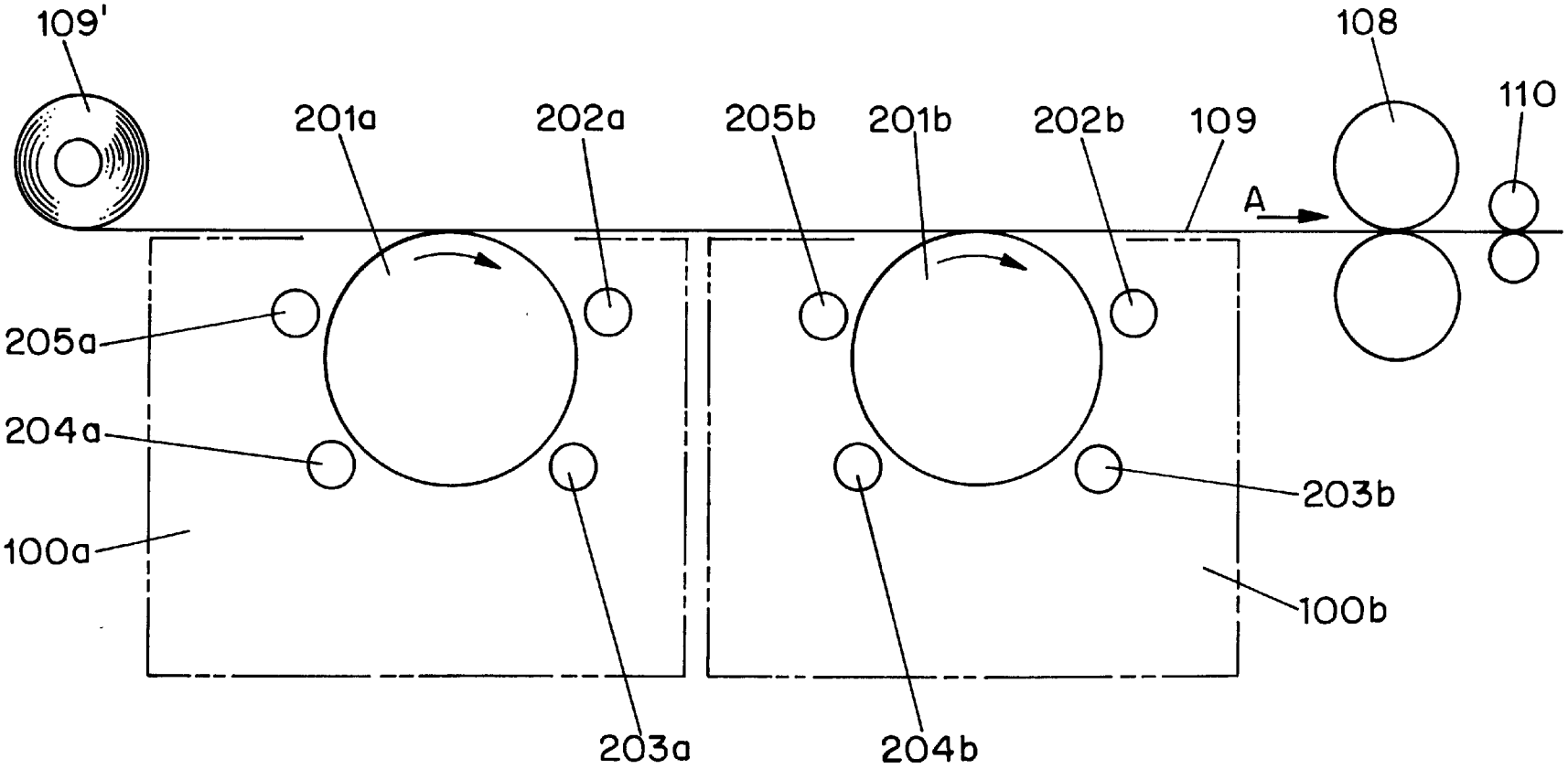
FIG. 4. is a schematic illustration of a printer according to the first specific embodiment of the invention using electrophotographic printing engines.

In FIG. 4, a detailed lateral view of a printer according to the first specific embodiment of this invention, and using classical electrophotographic printing engines, is given. The electrophotographic printing engines shown in FIG. 4 are equally well suited for use in the second specific embodiment of the invention.

This printer comprises electrophotographic printing engines (100*a* and *b*), means (108) to move the substrate in web form (109), withdrawn from a roll (109') in the direction of arrow A and means (110) to fix the toner image to the substrate. Each printing engine (100*a* and 100*b*) comprises a photoconductive drum (201*a* and *b*), rotating in the direction of the arrow, as latent image bearing member. The photoconductive drum contacts the substrate (109) to be printed or is arranged to be very close to the substrate. Each engine comprises further, arranged around each photoconductive drum, in the direction of rotation: a cleaning unit (202*a* and *b*), a charging unit (203*a* and *b*), an exposure unit (204*a* and *b*) and a toner delivery unit (205*a* and *b*). The transfer from the toner image to the substrate (109) can be aided by transfer means, e.g. a transfer corona.

Figure 5:
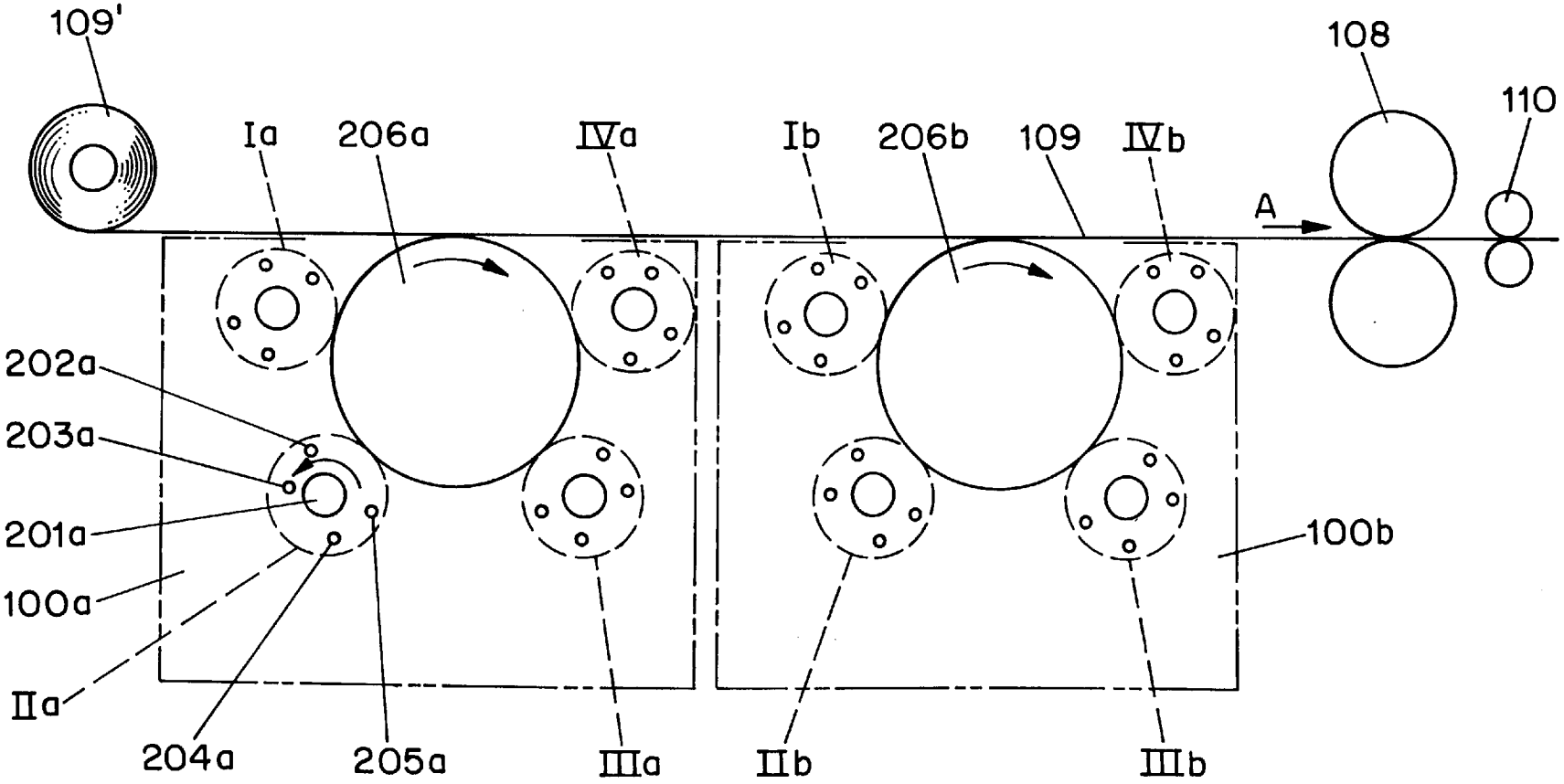
FIG. 5. is a schematic illustration of an other possible configuration of a printer according to the first specific embodiment of the invention using electrophotographic printing engines.

When so desired each of the printing engines (100*a* and *b*) can, within the scope of this invention, comprise, as shown in FIG. 5, an intermediate toner receiving member (206*a* and *b*), rotating in the direction of the arrow. The engines (100*a* and *b*) comprise further, arranged around each of the intermediate members (206*a* and *b*), electrophotographic engines (Ia, IIa, IIIa, IVa, Ib, IIb, IIIb, and IVb) that image-wise deliver toner particles to the intermediate member. The printer comprises further means (108) to move the substrate (109) in web form, withdrawn from a roll (109') in the direction of arrow A and means (110) to fix the toner image to the substrate. The electrophotographic engines, delivering toner particles to the intermediate members (Ia, IIa, IIIa, IVa, Ib, IIb, IIIb, and IVb), shown in FIG. 4, are all the same and have the configuration as described in FIG. 3. Therefore in FIG. 4, only one of the engines (Ia) for image-wise delivering toner particles to the intermediate member has be provided with numerical indications of the parts. Each of the engines comprise a photoconductive drum (201), rotating in the direction of the arrow. The photoconductive drum contacts the intermediate member (206) or is arranged very close to it. Around each photoconductive drum are arranged in the direction of rotation: a cleaning unit (202), a charging unit (203), an exposure unit (204) and a toner delivery unit (205). Transfer means, e.g. a transfer corona, can be incorporated in the printing engines to assist both the transfer of the toner particles from the latent image bearing member to the intermediate member and from the intermediate member to the substrate to be printed.

The intermediate member can be a cylinder, a belt, etc.

In electrophotographic printing engines, useful in a printer according to this invention, the latent image bearing member may comprise an inorganic photoconductor, e.g., silicon or an organic photoconductor. The latent image bearing member can be in the shape of a drum, a belt, etc. The exposure means can be any exposure means known in the art, but digitally addressable exposure means are preferred, e.g. a laser, an array of LEDs, etc. When a laser is used, it is preferred to use a semi-conductor or a diode laser, for the sake of compactness of the printing engines.

The toner delivery means can be a magnetic brush assembly, using either a multi-component developer, comprising magnetic carrier particles and non-magnetic toner particles or a mono-component magnetic developer. The toner delivery means can also be an applicator for non-magnetic mono-component developer.

The FIGS. 3, 4 and 5, each schematically illustrating a printer according to the present invention, show printers wherein the substrate (109) to be printed is a web. It is evident that a printer according to the present invention capable to print on sheet material can easily be built.

In the first specific embodiment of the invention, where staggered printing engines (DEP engines as well as electrophotographical engines) are used, the staggered printing engines can be located on two lines. A first line comprising a printing engine, an empty space with a width equal to or smaller than the width of the printing engine, a second printing engine, a second empty space with a width equal to or smaller than the width of the printing engine, etc.. A second line comprising an empty space with a width equal to or smaller than the width of the printing engine, this empty space being located under the first printing engine of the first line, a printing engine located under the empty space of the first line, etc. The paper transport in such a printer configuration can, if necessary, be improved by placing a dummy roller structure in the empty spaces.

A third specific embodiment of the invention

According to a third specific embodiment of the present invention a printer according to the first and second specific embodiment of the invention, as described above, is incorporated in a moving shuttle-type printer so that a large format image is written in separate image bands (swaths). The shuttle is travelling over the image receiving member (substrate) in a first direction, preferably a direction that is essentially parallel to the width of the substrate to be printed. After having printed a single band over the width of the substrate, the substrate is moved in a direction different from said first direction, over a length corresponding to the width of the printhead structure and toner delivering means. The shuttle can have a printing with of at least 30 cm, preferably the shuttle has a printing width of at least 40 cm, more preferably 60 cm, and for printing very large substrate in a short printing time, even at least 120 cm. This is different from the shuttling printers known in the art while by the third specific embodiment of this invention broader bands can be printed. This means that even with a fairly low shuttling speed of the printer a large format print can be made in a short time. Such a shuttling printer according to the third specific embodiment of this invention can very beneficially be used for printing images of very large dimension (e.g. >5 meter width) with a very high printing speed (e.g. >500 $m^2$/hour).

A shuttle according to the present invention can, e.g., comprises three printing engines with a width of, e.g., 0.3 m, that are staggered and mounted in a shuttle in such a way that the three engines shuttle together without changing their relative positions to each other. Such a printer makes it possible, when the shuttling proceeds with the longest dimension of the shuttling printers (i.e. in this example 0.9 m width) perpendicular to the width of the large substrate, to print in one shuttle movement a band that is 0.9 m wide. It is clear that such a shuttle can be constructed with less or more printing engines, with wider or smaller engines, etc., without going beyond the scope of the third specific embodiment of this invention.

Figure 6:
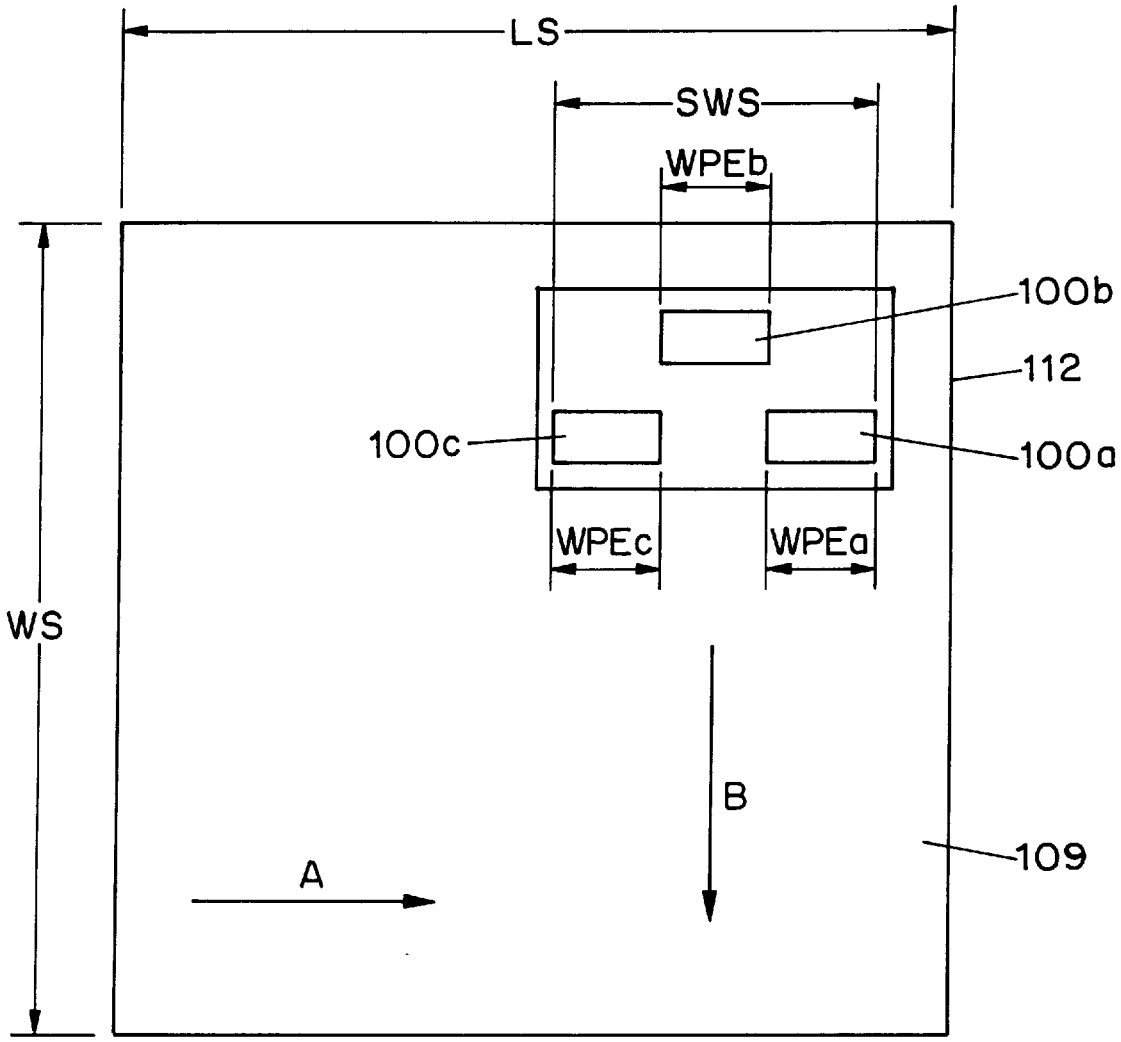
FIG. 6 is a schematic illustration of a printer according to a third specific embodiment of this invention.

In FIG. 6, a schematic view of a printer with shuttling printing engines is shown as a projection of the shuttle in the plane of the substrate (109) to be printed.

The shuttle (112), comprising 3 printing engines (100*a, b* and *c*), the respective engines having a width WPEa, b and c, moves over the width (WS) of the substrate to be printed in the direction of arrow B, and after having printed a single band over the width of the substrate, the substrate is moved in the direction of arrow A over a length corresponding to the working width (i.e. the width of the band (swath width of the shuttle, SWS) that can be printed) of the shuttle (112). The shuttle returns in a direction opposite to arrow B and prints the next swath.

The third specific embodiment of the invention can be implemented by "shuttling" a combination of staggered DEP devices or a combination of staggered electrophotographic printing devices. It is also possible to produce a shuttle wherein the printing engines are arranged as in the second specific embodiment of the present invention. Thus the present invention encompasses a printer, with printing width (PW), for printing a toner image on a substrate, having a width (WS) and a length (LS), comprising:

means for moving said substrate a first direction, means for moving a shuttle having a swath width, SWS, in a second direction, different from said first direction, said shuttle carrying a number n, equal to or larger than 2, of printing engines, each of said engines containing an element with a longitudinal axis (WPE) smaller than said swath width (SWS), for applying toner to said substrate, at least two of said n printing engines being located so that said longitudinal axis do not coincide.

In an other embodiment of a shuttling printer according to this invention, a printer is provided, with printing width (PW), for printing a toner image on a substrate, having a width (WS) and a length (LS), comprising:

means for moving said substrate a first direction, means for moving a settle having a swath width, SWS, in a second direction, different from said first direction, said shuttle carrying a number n, equal to or larger than 2, of printing engines, each of said engines containing an element with a longitudinal axis (WPE) smaller than said swath width (SWS), for applying toner to said substrate, at least two of said n printing engines being located so that said longitudinal axis do not coincide and said respective longitudinal axis of said elements for applying toner to said substrate are parallel to each other, and have a centre point located on a single line, said single line being essentially parallel to said swath width of said shuttle (SWS) and are inclined with respect to said single line by an angle $\alpha$, wherein $0° < \alpha < 90°$.

Any DEP device known in the art can be useful for implementing the third specific embodiment of the present invention. Typical examples of useful DEP device have been disclosed in, e.g. EP-A 675 417, EP-A 708 386, EP-A 710 897, EP-A 710 898, EP-A 731 394, EP-A 736 822, U.S. Pat. No. 5,539,438, U.S. Pat. No. 5,202,704, U.S. Pat. No. 5,283,594, U.S. Pat. No. 5,036,341, U.S. Pat. No. 5,374,949, U.S. Pat. No. 4,814,796, U.S. Pat. No. 5,204,696, U.S. Pat. No. 5,327,169, etc.

In the printing engines used in a printer according to this invention, any toner particle known in the art can be used. The use of printing engines operating with dry toner particles is preferred.

What is claimed is:

1. A single pass printer, having a printing width (PW) for printing a toner image on substrate, having a width (WS) and a length (LS) comprising a number n, equal to or larger than 2, of direct electrostatic printing engines, each having a longitudinal axis (WPE) smaller than said printing width (PW) for applying toner to said substrate, said number n of said direct electrostatic printing engines being positioned in the single pass printer so that said printing width (PW) is achieved, said respective longitudinal axis of said direct electrostatic printing engines being parallel to each other, said direct electrostatic printing engines having a center point located on a single line, said single line being essentially parallel to said width (WS) of said substrate, and each of said direct electrostatic printing engines being inclined with respect to said single line by an angle $\alpha$, wherein $0° < \alpha < 90°$.

2. A single pass printer according to claim 1, wherein each of said direct electrostatic printing engines have an equal width (WPE) wherein $\cos \alpha \geqq PW/(n.WPE)$.

3. A single pass printer according to claim 1, wherein each of said direct electrostatic printing engines comprises a toner source for providing a flow of toner particles to said substrate and a cloud of toner particles near a printhead structure, said printhead structure containing a non-staggered set of rows of printing apertures, control electrodes associated therewith, for image-wise controlling said flow.

4. A single pass printer according to claim 3, wherein said toner source comprises a charge toner conveyor whereon charged toner particles are provided from a magnetic brush.

5. A single pass printer according to claim 4, wherein said toner source comprises an applicator for a non-magnetic mono-component developer.

6. A single pass printer according to claim 2, wherein each of said direct electrostatic printing engines comprises a toner source for providing a flow of toner particles to the substrate and a cloud of toner particles near a printhead structure, said printhead structure containing a non-staggered set of rows of printing apertures and control electrodes associated therewith for image-wise controlling said flow.

7. A single pass printer according to claim 6, wherein said toner source comprises a charged toner conveyor whereon charged toner particles are provided from a magnetic brush.

8. A single pass printer according to claim 7, wherein said toner source comprises an applicator for a non-magnetic mono-component developer.

* * * * *